US007971412B1

(12) United States Patent
Lim

(10) Patent No.: US 7,971,412 B1
(45) Date of Patent: Jul. 5, 2011

(54) BALUSTER SYSTEM AND METHOD

(75) Inventor: Kok Jit Lim, Greensboro, NC (US)

(73) Assignee: S.V. International Corp., Greensboro, NC (US)

( * ) Notice: Subject to any disclaimer, the term of this patent is extended or adjusted under 35 U.S.C. 154(b) by 35 days.

(21) Appl. No.: 12/551,925

(22) Filed: Sep. 1, 2009

Related U.S. Application Data

(63) Continuation-in-part of application No. 12/206,802, filed on Sep. 9, 2008, now abandoned.

(51) Int. Cl.
*E04C 3/00* (2006.01)

(52) U.S. Cl. ..... 52/832; 52/835; 52/298; 52/704

(58) Field of Classification Search ..... 52/832, 52/835, 170, 40, 298, 704, 706; 256/22, 256/65.14, DIG. 2, DIG. 5; 403/315–320; 312/208; 181/222, 223, 130–132; 108/144.11, 108/147.19, 147.21; 135/77, 78, 80, 15, 135/81; 248/530, 532, 533, 222.14, 508; 285/402, 396, 361, 304
See application file for complete search history.

(56) References Cited

U.S. PATENT DOCUMENTS

| | | | | | |
|---|---|---|---|---|---|
| 50,372 | A | | 10/1865 | Lyon | 285/361 |
| 239,080 | A | * | 3/1881 | Baker | 52/298 |
| 349,240 | A | * | 9/1886 | Thomas | 52/155 |
| 891,448 | A | * | 6/1908 | Snider | 52/157 |
| 1,243,508 | A | | 10/1917 | Gorton | 108/147.19 |
| 1,391,001 | A | * | 9/1921 | Moore | 52/165 |
| 2,027,493 | A | | 1/1936 | Thilborger | 256/19 |
| 2,084,239 | A | | 6/1937 | Bradford | 52/156 |
| 2,103,948 | A | | 12/1937 | Jones | 248/530 |
| 2,209,504 | A | * | 7/1940 | Better | 248/530 |
| 2,253,768 | A | | 8/1941 | Dopson | 294/134 |
| 2,480,578 | A | | 8/1949 | Hodges | 425/17 |
| 2,598,999 | A | | 6/1952 | Kelly | 256/25 |
| 2,748,261 | A | | 5/1956 | Wolar | 362/413 |
| 3,021,114 | A | | 2/1962 | O'Connell | 256/24 |
| 3,245,181 | A | | 4/1966 | Stephenson | 52/126.4 |
| 3,352,084 | A | | 11/1967 | Seery | 52/832 |
| 3,471,129 | A | | 10/1969 | Mpakarakes | 256/24 |
| 3,583,116 | A | | 6/1971 | La Gue | 52/298 |
| 4,644,713 | A | * | 2/1987 | Lehman | 52/165 |
| 4,981,276 | A | | 1/1991 | Agor et al. | 248/222.14 |
| 5,437,433 | A | | 8/1995 | Rezek | 256/67 |
| 5,568,909 | A | * | 10/1996 | Timko | 248/519 |
| 5,622,356 | A | | 4/1997 | Duggan | 256/1 |
| 5,662,304 | A | | 9/1997 | McDaniel | 248/499 |
| 5,832,675 | A | * | 11/1998 | Zuares | 52/60 |
| 5,901,525 | A | * | 5/1999 | Doeringer et al. | 52/835 |
| D416,401 | S | * | 11/1999 | Taylor | D6/417 |
| 6,032,880 | A | * | 3/2000 | Verrills et al. | 248/530 |
| 6,115,985 | A | * | 9/2000 | Wu | 52/832 |
| 6,145,814 | A | | 11/2000 | Perrot | 256/67 |
| 6,256,961 | B1 | * | 7/2001 | Byrnes | 52/835 |
| 6,257,557 | B1 | * | 7/2001 | Anderson et al. | 256/1 |
| 6,336,620 | B1 | | 1/2002 | Belli | 248/519 |
| 6,402,117 | B1 | | 6/2002 | Tsai | 248/530 |
| 6,547,203 | B1 | | 4/2003 | Willard | 248/530 |

(Continued)

*Primary Examiner* — Robert J Canfield
*Assistant Examiner* — Babajide Demuren

(57) ABSTRACT

Stairway balusters are described which includes baluster extensions for ease in use, adjustability and convenience during installation, replacement or remodeling. The various extensions illustrated all allow the baluster shaft to adjust longitudinally. If a single baluster is being replaced on site, the baluster can be shortened using the adjustable features while removing. Also, during retrofitting the described method allows a baluster to be shortened, positioned in place and then lengthened to the desired height without undue modification or effort by the installer. Various extension embodiments are demonstrated.

18 Claims, 14 Drawing Sheets

U.S. PATENT DOCUMENTS

| | | | | |
|---|---|---|---|---|
| 6,568,145 | B2 | 5/2003 | Bartel | 52/741.2 |
| 6,702,239 | B2 | 3/2004 | Boucher | 248/156 |
| 6,886,296 | B1 | 5/2005 | John et al. | 52/170 |
| 6,925,754 | B1 | 8/2005 | Tearoe | 47/47 |
| 7,007,910 | B1 | 3/2006 | Krinner et al. | 248/530 |
| 7,044,448 | B1 * | 5/2006 | Jones | 256/19 |
| 7,168,373 | B1 | 1/2007 | Hock | 108/147.21 |
| 7,219,872 | B2 | 5/2007 | Walker | 248/516 |
| 7,228,669 | B1 | 6/2007 | Yaraschefski | 52/506.06 |
| 7,438,273 | B2 * | 10/2008 | Tota | 248/545 |
| 7,530,550 | B2 | 5/2009 | Fattori | 256/65.05 |
| 2003/0173474 | A1 * | 9/2003 | Taylor | 248/156 |
| 2004/0003568 | A1 | 1/2004 | McCarthy | 52/720.2 |
| 2005/0023428 | A1 | 2/2005 | Woude et al. | 248/530 |
| 2005/0211857 | A1 * | 9/2005 | Bolinder et al. | 248/156 |
| 2005/0279896 | A1 * | 12/2005 | Callies | 248/218.4 |
| 2007/0120035 | A1 | 5/2007 | Albanese et al. | 248/530 |
| 2007/0176159 | A1 | 8/2007 | Schram et al. | 256/65.14 |
| 2008/0029678 | A1 | 2/2008 | Harold et al. | 248/530 |
| 2008/0173857 | A1 * | 7/2008 | Edwards | 256/67 |

* cited by examiner

BALUSTER SYSTEM AND METHOD

This is a continuation-in-part of and claims benefits under pending prior patent application Ser. No. 12/206,802 filed 9 Sep. 2008 now abandoned.

FIELD OF THE INVENTION

The invention herein pertains to stairway balusters and particularly pertains to stairway balusters which can be easily installed, exchanged or replaced during construction, remodeling or redecorating the interior of a building such as a house or office.

DESCRIPTION OF THE PRIOR ART AND OBJECTIVES OF THE INVENTION

Many homes and offices utilize stairway handrails and balusters which sometimes become damaged during activities such as moving furniture, equipment or inadvertent striking of the balusters or the like. Such balusters which are oftentimes installed with the use of nails, screws, or adhesives are often difficult to remove. During reinstallation or repair work it is time consuming and usually not desirable to remove the entire handrail. However, as conventional balusters are often fitted within channels in the handrail, to remove only a single baluster is exceedingly difficult without damaging the handrail or adjacent balusters. It is labor intensive and expensive to replace conventional balusters, whether replacing one, several or all.

Thus in view of the problems and difficulties associated with the repair, removal or installation of standard stairway balusters, the present invention was conceived and one of its objectives is to provide a baluster which can be longitudinally adjusted to provide convenience in the repair, installation or removal process.

It is another objective of the present invention to provide a baluster having an extension which can be used to shorten and lengthen the baluster shaft during installation.

It is still another objective of the present invention to provide a baluster with a decorative shoe for mounting on the stairway tread and a baluster cap for hand rail attachment to improve aesthetic qualities.

It is yet another objective of the present invention to provide various baluster assemblies for selection and adjustment on site.

It is also an objective of the present invention to provide a baluster with a two part shaft and an exchangeable ornament for aesthetic purposes.

It is a further objective of the present invention to provide a method of baluster installation which allows one or more balusters to be exchanged, replaced and installed in a quick and efficient manner by those with relatively little training or skill.

It is still a further objective of the present invention to provide a baluster which is inexpensive to manufacture and purchase and which can be used to replace a variety of different length conventional balusters.

Various other objectives and advantages of the present invention will become apparent to those skilled in the art as a more detailed description of the invention is set forth below.

SUMMARY OF THE INVENTION

The aforesaid and other objectives are realized by providing a method for on site exchange or replacement of one or more installed stairway balusters that have been conventionally manufactured by turning on a lathe for a chosen design. Balusters of conventional type have no longitudinal adjustability and are usually formed having an average length and are then cut to a precise height or length on site during the installation process. Stair treads formed of oak or other dense woods are often drilled if required to form a baluster socket. Once the balusters are installed in the tread sockets and optionally the stair well landings, a handrail containing a series of shallow channels for receiving the tops of the balusters can then be attached by the use of a standard fastener such as adhesives, nails or screws. Initial installation is then complete. The baluster components may be formed from wood, metal or plastics as best suited for a particular installation.

Subsequently, if a baluster becomes damaged or if the home or building owner decides to redecorate or remodel, first the handrail is generally completely removed so the balusters, one or more can be replaced as desired.

The present invention prevents the necessity of removing the entire handrail due to the longitudinal adjustability of the balusters which take on one or more of several embodiments with various adjustable means. First, a baluster is described which includes a longitudinal shaft, an extension adjustably connected to the shaft containing a sphere set which is resiliently loaded. Another embodiment includes an extension with an angled slot which utilizes a locking pin while yet another embodiment includes an extension having a plurality of mounting holes for receiving allen screws to provide an adjustable connection to the longitudinal shaft. Another form of the invention utilizes a double threaded hanger bolt for joining a base extension to a baluster shaft. In the method of use, the baluster shaft having a longitudinal channel is placed over the extension and sets of spheres. The shaft can then be raised along the extension and the sphere sets then extend to prevent the shaft from descending their post so the terminal end of the shaft will rest on the uppermost extended sphere set. The sphere sets may be separated about one half inch (1.25 cm) so the baluster shaft can be adjusted in heights of 1.25 cm. A shoe surrounding the shaft can be slid over the extension to thus form a decorative completion which will conceal the extension. A decorative cap surrounding the shaft can be used to conceal the connection of the baluster to the hand rail. Other extension embodiments with other adjustable configurations and the methods of installation are also included herein along with handrail connectors for easily attaching the baluster to a handrail by use of a spring loaded plunger or a threadable baluster tip. In addition, replaceable ornaments are disclosed which add to the aesthetics of the baluster. Such balusters may be formed of cast iron or other materials and the ornaments are threaded in placed between upper and lower baluster sections.

DETAILED DESCRIPTION OF THE PREFERRED EMBODIMENT AND OPERATION OF THE INVENTION

Figure 1:
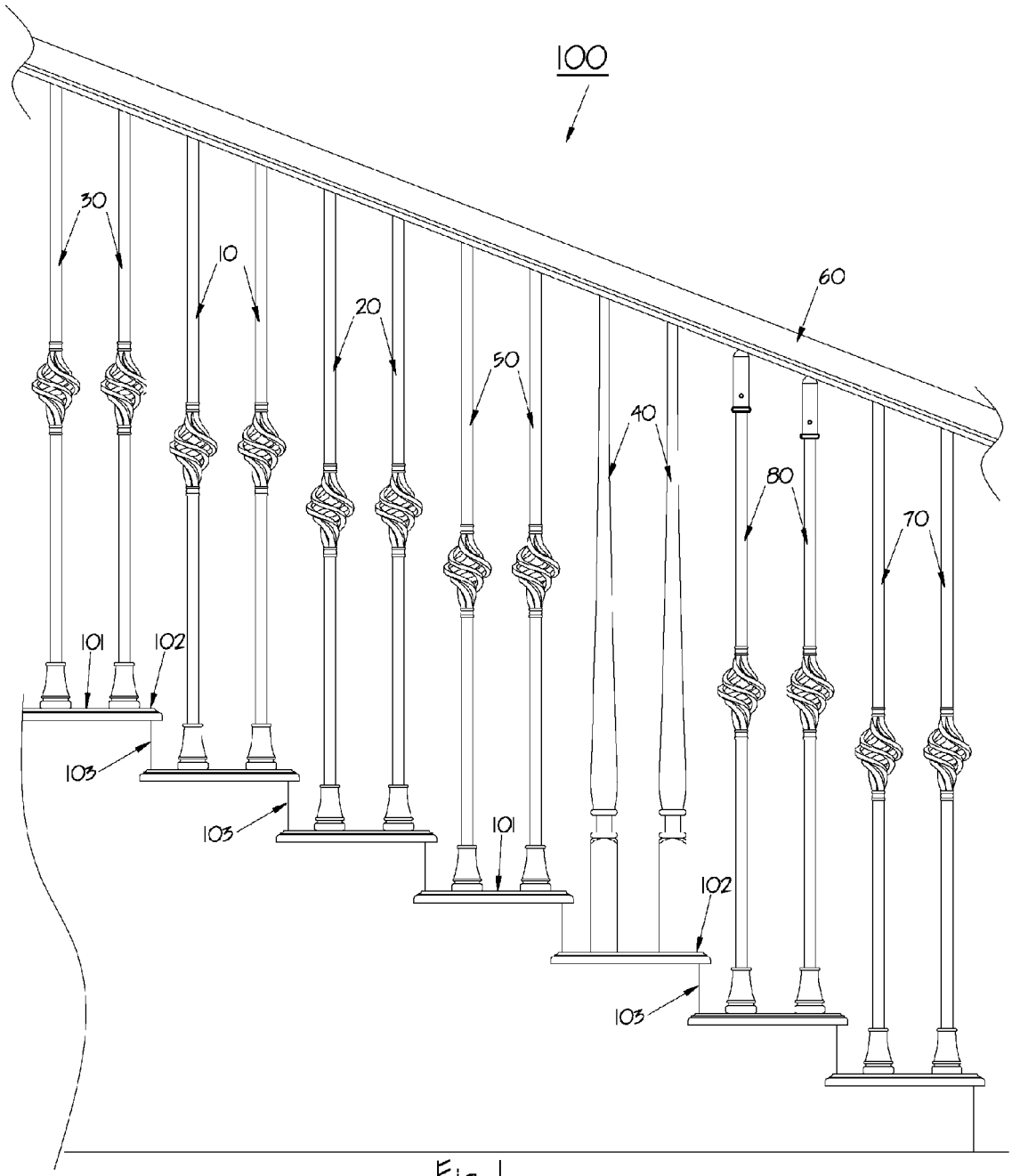
FIG. 1 shows a typical, partial stairway in schematic form utilizing various baluster embodiments of the invention.

For a better understanding of the invention and its operation, turning now to the drawings for illustration of the baluster embodiments and method steps of the installation of each, FIG. 1 shows a schematic stairway 100 having steps 101, treads 102 and risers 103 as conventional in the trade. Affixed to treads 102 are a series of balusters of the invention such as preferred baluster 10 and alternate balusters 20, 30, 40, 50, 70 and 80 as will be explained hereinafter in more detail. As shown, handrail 60 is attached to baluster 40 and as would be understood would be connected to all balusters 10, 20, 30, 50, and 80 in actual use. All shown balusters, steps and handrails could be formed from wood, metal or composites as desired. Stairwell 100 may be used in a home or in a commercial building.

Figures 2, 3, 4, 5:
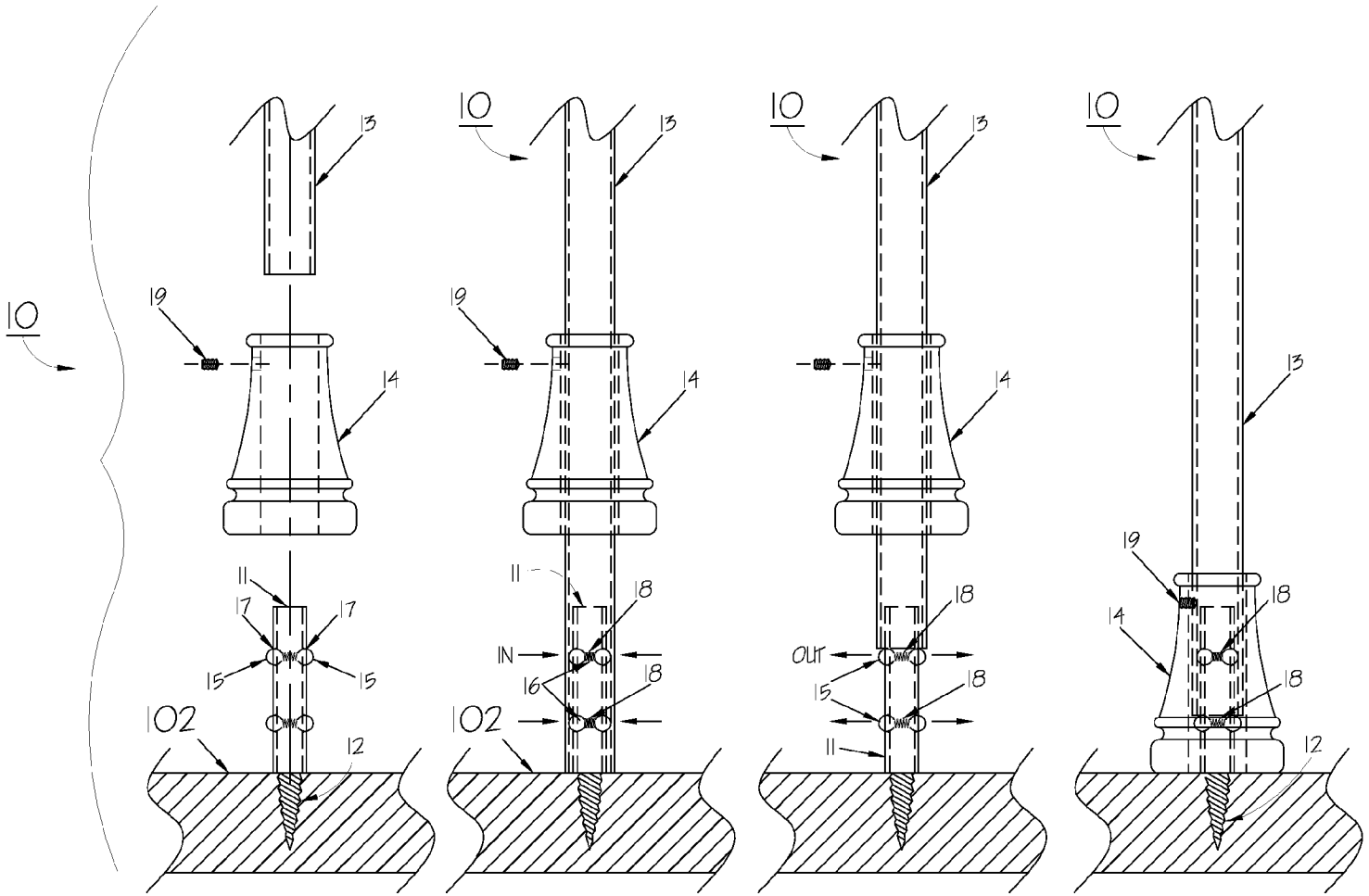
FIG. 2 demonstrates the preferred embodiment of the bottom of the length adjustable baluster of the invention in an abbreviated, exploded form with a stair tread.
FIG. 3 depicts the baluster embodiment of FIG. 2 with the baluster shaft secured in a most downward posture.
FIG. 4 pictures the baluster shaft of FIG. 3 raised and resting on the upper sphere set.
FIG. 5 features the baluster of FIGS. 2-4 as installed and finally adjusted and covered by the shoe.

Preferred baluster 10 is shown in more detail in FIGS. 2-5 in abbreviated form. In FIG. 2 baluster 10 is seen exploded with tubular extension 11 having tapered threaded anchor 12 mounted into tread 102. Extension 11 has a round tubular shape with a diameter smaller than the inner diameter of hollow baluster shaft 13 and is sized to closely fit within. Shaft 13 slides within shoe 14 which is bell shaped and receives extension 11 as depicted in FIGS. 3, 4 and 5. Extension 11 includes sphere sets 16 which are spring loaded and act as a stop consisting of two spheres 15 and coil spring 18 therebetween. In FIG. 2, sphere sets 16 (two shown) with spheres 15 are shown captured within apertures 17 so each sphere 15 can somewhat protrude by pressure applied from coil springs 18. Thus, the diameter of apertures 17 are each less then the diameter of spheres 15 to prevent removal as coil springs 18 apply outward pressure to spheres 15. However, springs 18 can be urged inwardly by descending shaft 13 which contacts spheres 15 as seen in FIG. 3. During installation method of baluster 10, extension 11 is mounted in tread 102 as shown in FIG. 2 and hollow baluster shaft 13 is then urged downwardly, over spheres 15 of sphere sets 16 as seen in FIG. 3.

During a remodeling or retrofitting, the method requires a selected baluster such as baluster 10 be positioned between handrail 60 and stair tread 102, with extension 11 mounted in tread 102. Shaft 13 having shoe 14 thereon is then positioned on extension 11 and lifted upwardly, as needed, along extension to a suitable height to contact handrail 60 for rigid attachment thereto. In FIGS. 4 and 5, shaft 13 is seen raised to its final resting position on upper spheres 15 which have protruded through apertures 17, as possible, as opposed to spheres 15 in FIG. 3 which are seen retracted. As would be understood, FIGS. 2, 3, 4 and 5 show only two (2) sphere sets 16 in extension 11, however more or less number of sphere sets 16 may be available for use depending, on the cost, installation and other manufacturing aspects. Once shaft 13 is so positioned as seen in FIG. 5 the top of shaft 13 can then be finally affixed as conventional to handrail 60 by fasteners (not seen) such as adhesives, nails, screws or the like. Once shaft 13 is so attached to handrail 60, shoe 14 which is slidably pre-positioned on shaft 13 is then urged downwardly as required to rest on tread 102 as shown in FIGS. 1 and 5. Conventional allen set screw 19 passes through a threaded aperture on shoe 14 and is tightened into contact with extension 11 to prevent movement of shoe 14 as shown in FIG. 5.

Figures 6, 7, 8, 9:
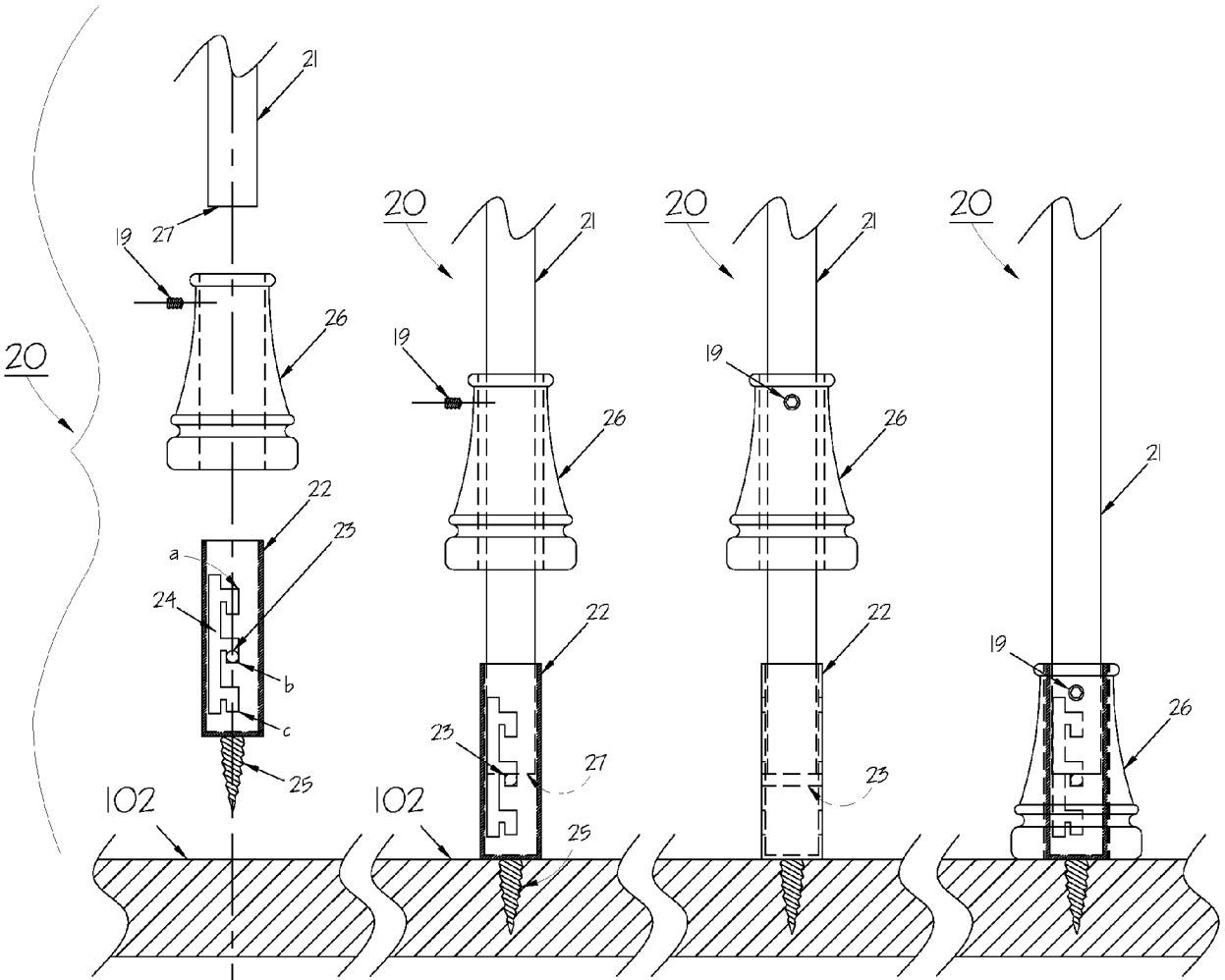
FIG. 6 illustrates in abbreviated, exploded fashion an alternate embodiment of the bottom of the baluster invention having a slotted extension as would be positioned on a stair tread.
FIG. 7 shows the slotted extension as seen in FIG. 6 as mounted in a stair tread.
FIG. 8 demonstrates the baluster and extension shown in FIG. 7 rotated ninety degrees (90°)
FIG. 9 features the extension as seen in FIG. 7 with the shoe fully lowered and resting on the stair tread.

In FIGS. 6-9 a first alternate embodiment of preferred baluster 10 is shown by baluster 20. Baluster 20 is illustrated as a wrought iron baluster but could be formed from wood, composites or other materials as standard in the trade. Baluster 20 includes shaft 21 positioned within rectangular hollow extension 22 which may be formed from a thin, durable metal. In the method of use, anchor 25 which is similar to anchor 12 as shown in FIG. 2 is threaded into stair tread 102 as shown in FIGS. 7, 8 and 9 for stability purposes. Once anchor 25 rigidly affixed to extension 22 is mounted in tread 102, shoe 26 is slidably mounted on shaft 21. Shaft 21 is then placed within extension 22 until terminal end 27 of shaft 21 is substantially coplanar with the bottom of extension 22. As earlier described, shaft 21 can then be raised along extension 22 and affixed to stair handrail 60 as seen in FIG. 1.

Extension 22 includes slot 24 which preferably consists of a series of communicating small vertical "h" slots for example subordinate slots a, b and c as seen in FIG. 6. As extension 22 is rectangularly shaped, a pair of identical slots 24 are opposingly positioned on each side of extension 22. Subordinate slots a, b and c in combination with pin 23 act as stops for shaft 21 by receiving cylindrical steel pin 23 therein as seen in FIG. 6 showing pin 23 in subordinate slot b. Upon sliding shaft 21 into extension 22 terminal end 27 will come to rest upon pin 23 as shown in FIG. 8. As would be understood, by lifting shaft 21 upwardly for attachment with handrail 60, steel pin 23 can be placed into the proper subordinate slot a, b or c along slots 24 on each side of extension 22 to accommodate the height required for shaft 21. For example, if shaft 21 needs to be longer to properly engage handrail 60, then subordinate slot a would be used. If shaft 21 requires a shorter length either subordinate slot b or c could be employed and pin 23 accordingly positioned. The terminal end 27 of shaft 21 as shown in FIG. 6 will then rest on properly placed pin 23 as seen in FIG. 9. Thereafter shoe 26 is slid downwardly along shaft 21 until it reaches tread 102, set screw 19 is tightened and after properly affixing the top of shaft 21 to handrail 60, the installation or retrofitting of baluster 20 is completed. Shoe 26 conceals extension 22 for aesthetic purposes. FIGS. 6-9 show generally the sequence of steps for the method of installation of baluster 20 which as would be understood, the steps can be performed in reverse order for baluster removal or further length adjustment as required.

Figures 10, 11, 12, 13:
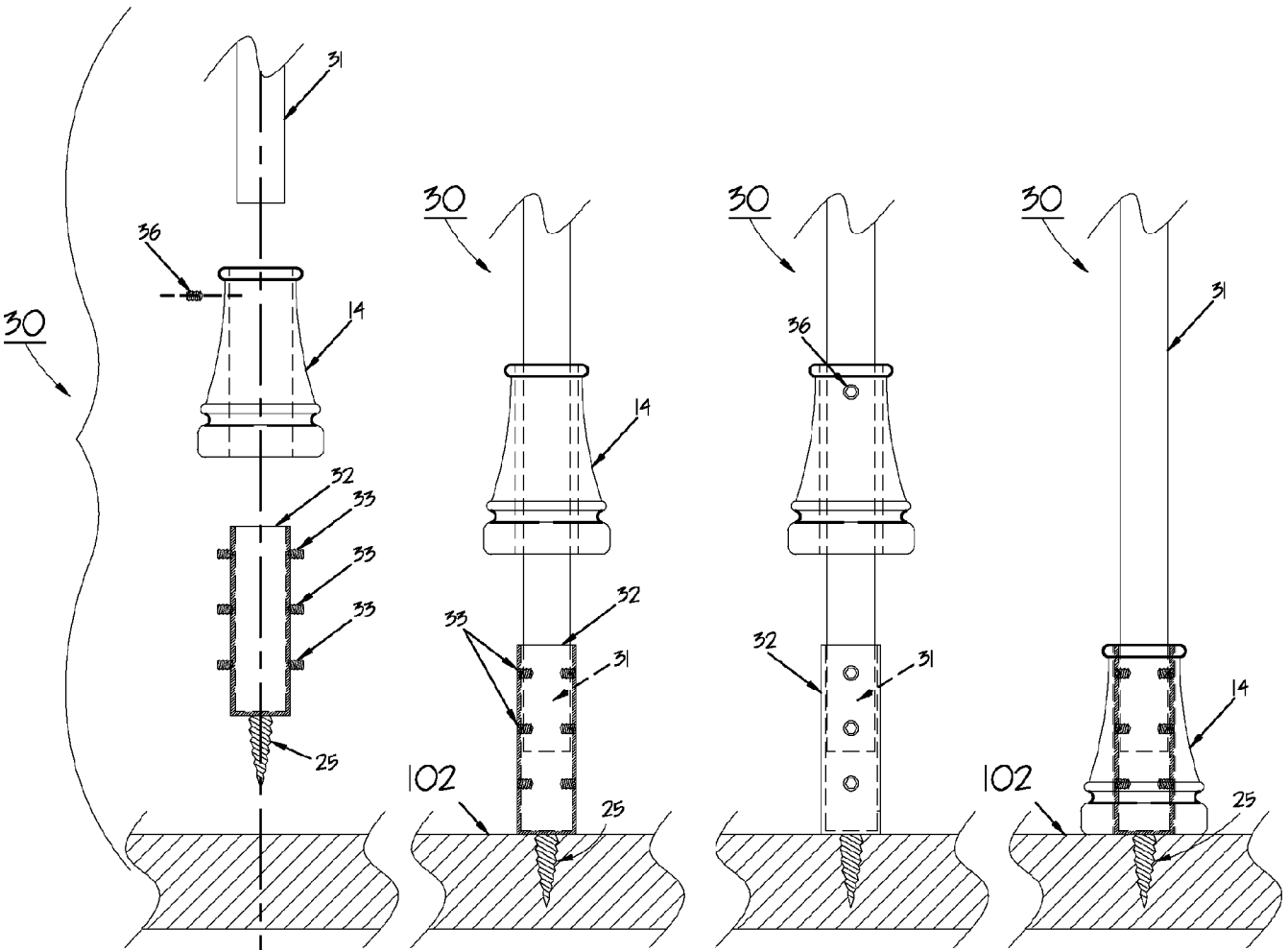
FIG. 10 shows another alternate, exploded form of the baluster extension with allen retainers as would be positioned on a stair tread.
FIG. 11 illustrates the baluster embodiment seen in FIG. 10 with the baluster contained within the extension.
FIG. 12 depicts the embodiment of FIG. 11 rotated 90'.
FIG. 13 pictures the embodiment of FIG. 11 with the shoe lowered against the stair tread.

In FIGS. 10-13 a second alternate baluster 30 is shown with shaft 31, extension 32 and shoe 14. As seen, rectangular extension 32 is hollow to accept shaft 31 in any of a variety of positions as adjustable along extension 32. Extension 32 has a series of three opposing sets of allen retainers 33. Only one (1) threaded retainer is required. Threaded anchor 25 can be tightened into stair tread 102 as shown in FIG. 11 and then by sliding shaft 31 to a suitable height as also seen, allen retainers 33 can then be tightened into shaft 31 at the desired height as seen in FIG. 12. Thereafter shoe 14 can be slid downwardly onto stair tread 102 and screw 36 tightened to maintain shaft 31 in a stable, desired location as seen in FIG. 13.

Figure 14:
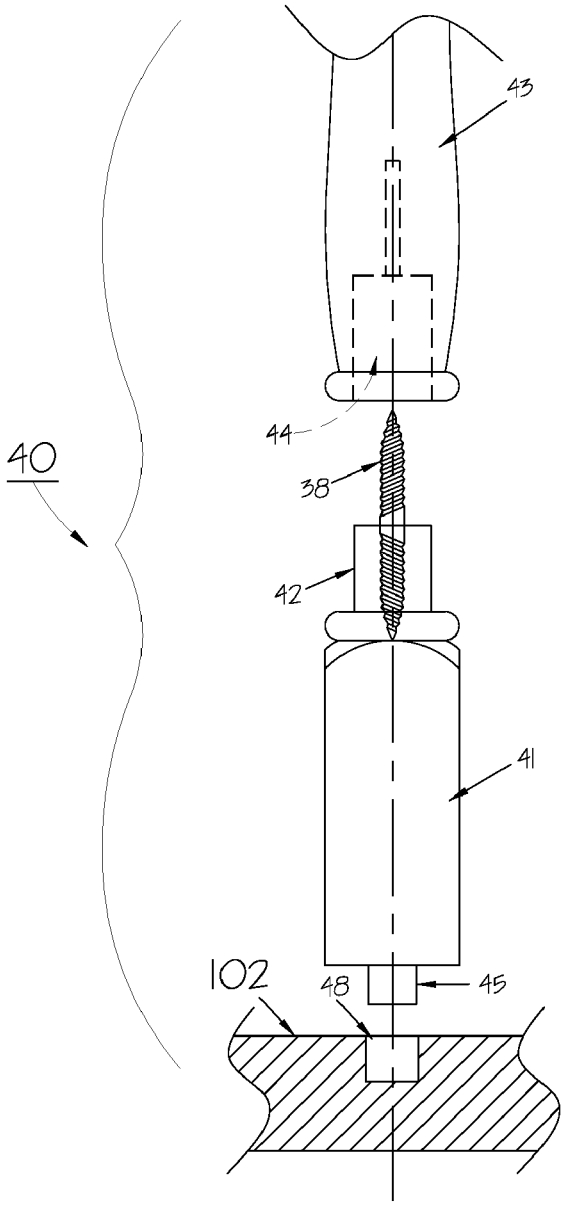
FIG. 14 demonstrates another embodiment of a baluster extension with a double threaded hanger bolt in exploded fashion as would be joined to a stair tread.
Figure 15:
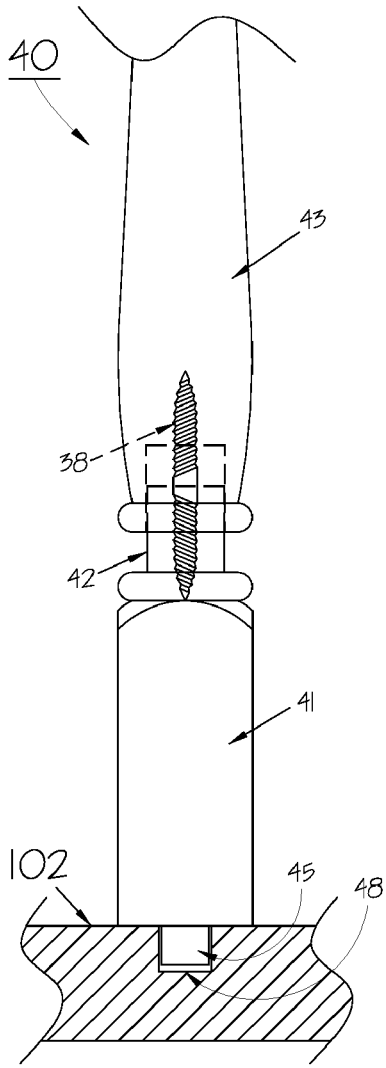
FIG. 15 features the embodiment seen in FIG. 14 in assembled form.

In FIGS. 14 and 15 a third alternate form of the baluster is shown by baluster 40 with double threaded hanger bolt 38. Here, baluster extension 41 which may be round or rectangular is seen which consists preferably of a wood construction and includes lower anchor member 45 and upper stud 42. Hanger bolt 38 includes opposing threads and is incorporated into upper stud of extension 41 whereby baluster shaft 43 which is also preferably formed from wood is tightened onto extension 41. Baluster shaft 43 is thereby adjustable, depending on the depth of penetration of threaded hanger bolt 38 within internal threaded channel 44. As seen in FIG. 15, shaft 43 is approximately 1.25 cm from being totally seated on extension 41. Also, extension 41 is seen in FIG. 15 with stud 45 placed in opening 48 formed such as by boring into stair tread 102. As desired, once suitably tightened, any gap between shaft 43 and extension 41 can be caulked such as with a conventional acrylic caulk and painted so the joint therebetween will not be readily visible. Optionally a shoe such as shoe 47 with conventional set screw 19 could also be utilized for aesthetic purposes as hereinbefore described.

Figure 15A:
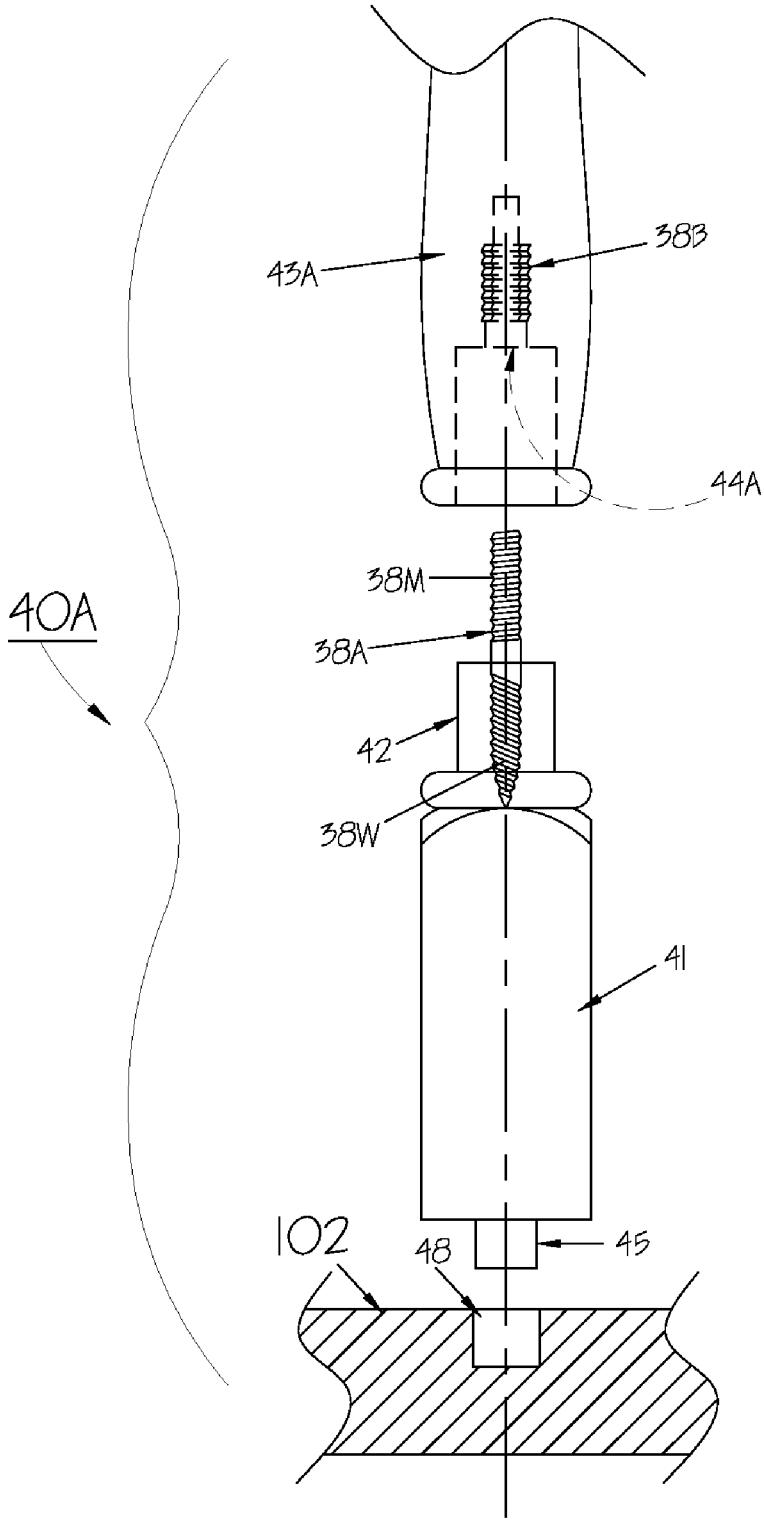
FIG. 15A shows another embodiment of the baluster extension with a dual threaded hanger bolt and threaded metal insert seen in exploded fashion.

In FIG. 15A alternate embodiment 40A of the baluster is shown in exploded fashion having dual threaded hanger bolt 38A. Hanger bolt 38A includes machine bolt threads 38M along the upper portion and wood screw threads 38W along the bottom portion. Wood screw threads 38W are seated in upper stud 42 of extension 41 whereas machine bolt threads 38M are to be seated in threaded metal insert 38B positioned in the upper part of internal channel 44A in baluster shaft 43A. Extension 41 is thus joined to baluster shaft 43A as described regarding baluster 40 with the exception that dual threaded hanger bolt 38A is threaded into metal insert 38B as described. Baluster shaft 43A is thus likewise adjustable, depending on the depth of penetration of hanger bolt 38A and stud 42 within baluster shaft 43A.

While balusters 10, 20, 30 and 40 are all shown herein as being adjustable at their lower ends, the balusters can also be adjustably received along their upper ends as seen in FIGS. 16-19. As would be understood the balusters adjustable connections on the lower ends and upper ends as shown and described could be easily interchanged during forming of the baluster to incorporate for example, the bottom connection of baluster 10 seen in FIG. 2 with the top connection of baluster 50 described below and seen in FIGS. 16 and 17.

Figure 16:
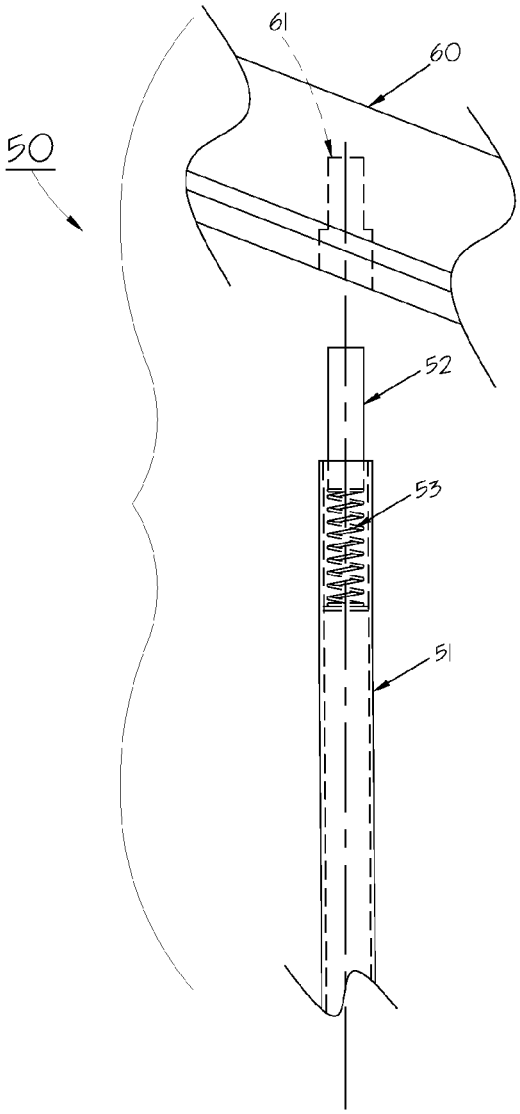
FIG. 16 depicts another alternate embodiment of the baluster in exploded fashion with a handrail having a spring loaded plunger in the top portion.
Figure 17:
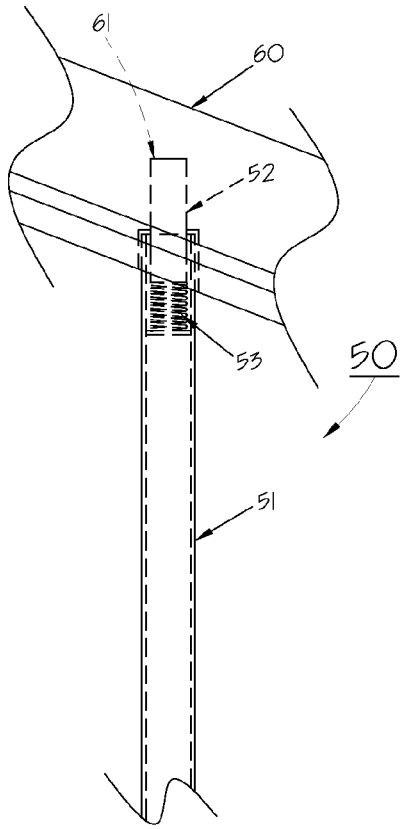
FIG. 17 features the baluster of FIG. 16 as installed on a stair handrail.

In FIG. 16, baluster 50 is illustrated in extended form and includes shaft 51 which may be formed from steel or other metal and generally having a hollow round tubular shape and includes internal rigid cylindrical plunger 52 preferably formed from steel which is spring loaded by spring 53. Spring 53 allows for shaft 51 height adjustability. FIG. 17 shows baluster 50 compressed and assembled with handrail 60. Thus, depending on the depth of handrail bore 61 and the length of shaft 51, baluster plunger 52 can be compressed against spring 53 as required.

Figure 19:
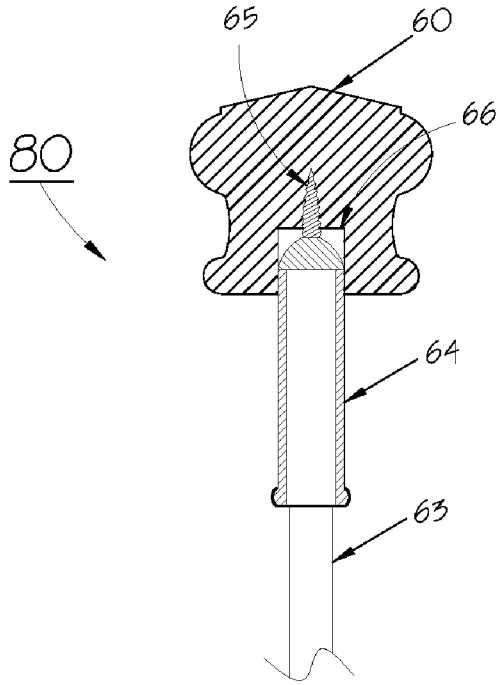
FIG. 19 depicts the baluster top extension as shown in FIG. 18 in assembled form.
Figure 18:
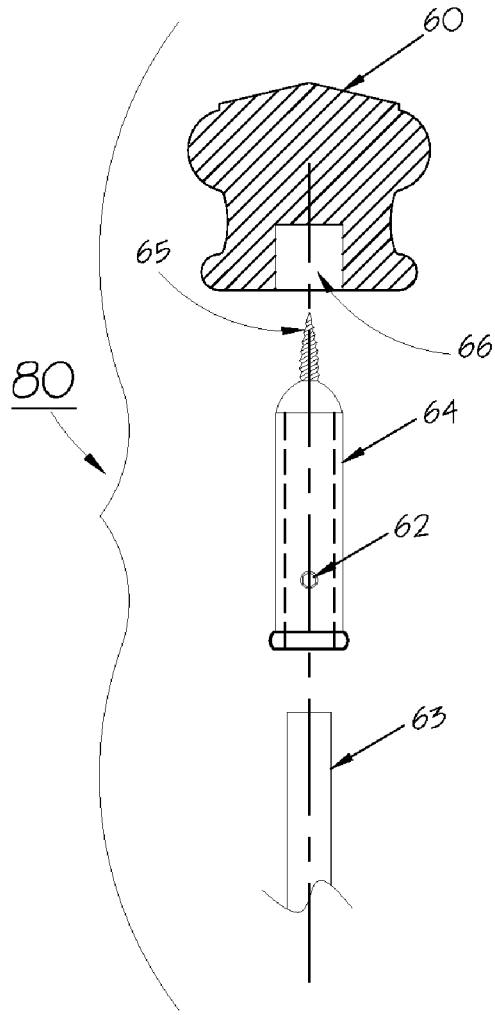
FIG. 18 shows a baluster top extension for a handrail in exploded fashion.

In FIGS. 18 and 19, handrail 60 is shown in cross-sectional view with baluster 80. Baluster 80 is seen exploded in FIG. 18 and includes shaft 63 and round extension 64 formed from metal, plastics or wood which includes threaded hanger bolt 65. Hanger bolt 65 is threaded into handrail 60 through bore 66 and shaft is tightenable in extension 64 by screw 62. Thus, for adjustable purposes, shaft 63 is slideable within extension 64 to a desired height where it is secured in place by screw 62. Extension 64 is affixed to handrail 60 by hanger bolt 65.

Figure 20:
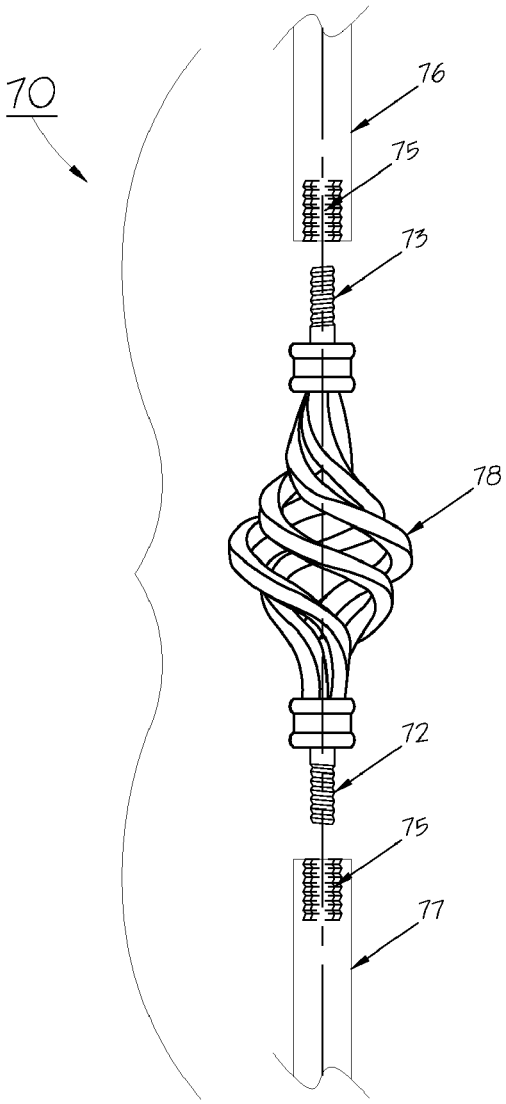
FIG. 20 features a baluster ornament as shown in FIG. 1 as exploded between top and bottom baluster sections.
Figure 21:
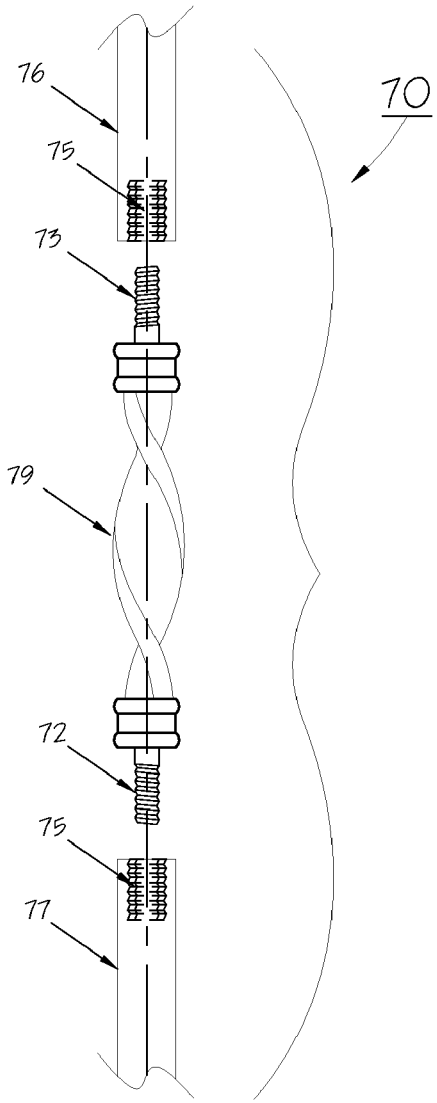
FIG. 21 demonstrates another baluster ornament as also exploded between top and bottom baluster sections.

FIGS. 20 and 21 demonstrate baluster 70 with replaceable ornaments 78 and 79 which can be formed from wrought iron, aluminum or other suitable materials. As seen in FIG. 20, ornament 78 includes lower threaded bolt 72 and upper threaded bolt 73 which are tightenable within threaded metal inserts 75 contained in baluster upper section 76 and lower section 77. Threaded metal inserts 75 can be inserted in wooden, metal or polymeric baluster sections as required and allow for a degree of baluster adjustment, depending on the amount of tightening performed. Likewise ornament 79 can be formed of any of a variety of materials and can be used interchangeably with ornament 78 for aesthetic purposes.

Figure 22:
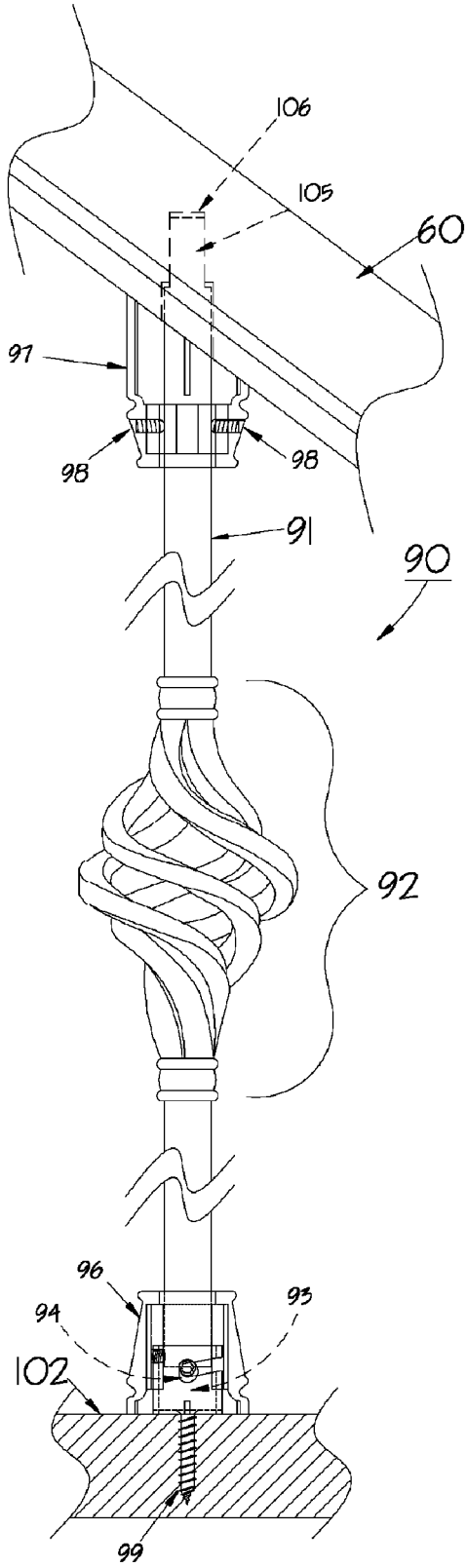
FIG. 22 shows another assembled baluster embodiment in schematic form.

Another embodiment of the invention is shown with baluster in various views throughout FIGS. 22-34. FIG. 22 schematically illustrates baluster 90 in assembled fashion joined to stair tread 102 and handrail 60. Baluster 90 includes elongated shaft 91 with ornamental section 92 consisting of a series of twists formed therein. Shaft 91 includes proximal end 104 which is positioned within rectangularly shaped hollow extension 93 joined to stair tread 102. Distal end 105 of shaft 91 is joined to handrail 60 by tubular channel 106 (FIG. 23).

Figure 26:
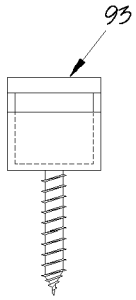
FIG. 26 provides a front elevational view of the extension in FIG. 25.
Figure 27:
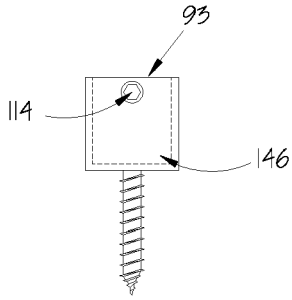
FIG. 27 demonstrates a rear elevational view of the extension in FIG. 25.
Figure 28:
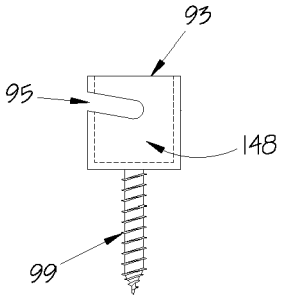
FIG. 28 shows a right side elevational view of the extension in FIG. 25.
Figure 29:
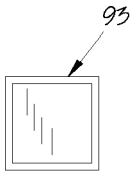
FIG. 29 features a top plan view of the extension in FIG. 25.
Figure 30:
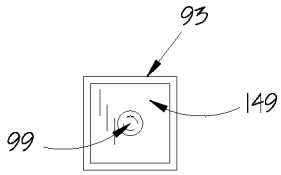
FIG. 30 shows a bottom plan view of the extension in FIG. 25.

Extension 93 as seen in FIGS. 25-30 is formed having top opening 143, front 145, rear 146, left side 147, right side 148 and bottom 149. Dashed lines in FIGS. 26-28 depict the wall thickness and illustrate the depth. Top opening 143 of extension 93 is sized to slideably receive shaft 91 therein. Bottom 149 includes rigidly affixed anchor 99 for attachment of extension 93 to stair tread 102. Angled slot 95 is formed in front 145 and extends through sides 147, 148 for receiving locking pin 94. Extension 93 is preferably about 2 and ¼ inches (5.71 cm) in length, overall with anchor 99 being about 1 and ¼ inches (3.17 cm) long. Extension 93 is formed from a thin gauge coated steel and is about ⅝ inches (1.58 cm) square with a length of about 1 inch (2.54 cm). Slot 95 has an angle of about ten-twelve degrees (10-12°) with a width of about 3/16 inches (0.474 cm) to slideably receive axle 120 of locking pin 94.

Figure 23:
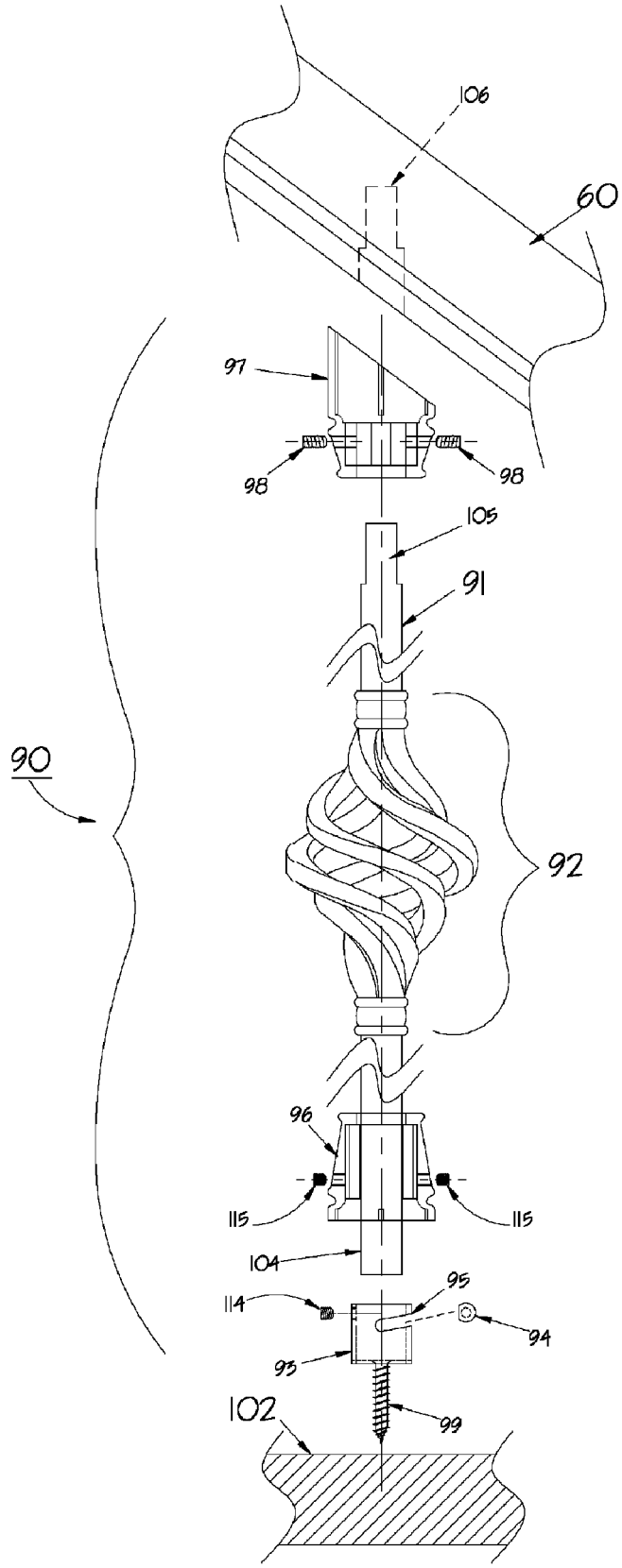
FIG. 23 depicts the baluster seen in FIG. 22 in exploded fashion prior to assembly.
Figure 24:
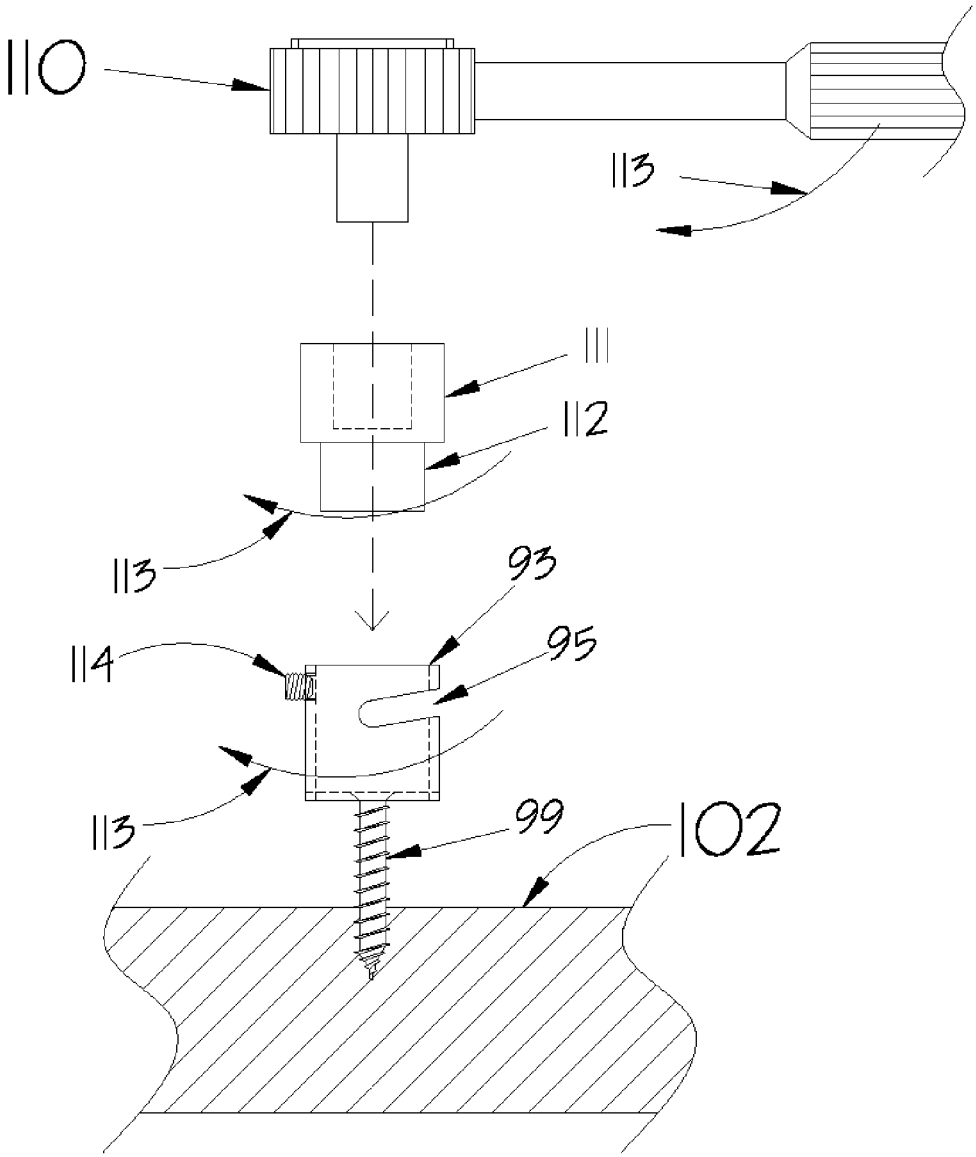
FIG. 24 pictures tools used in the installation method for the extension exploded for clarity.
Figure 25:
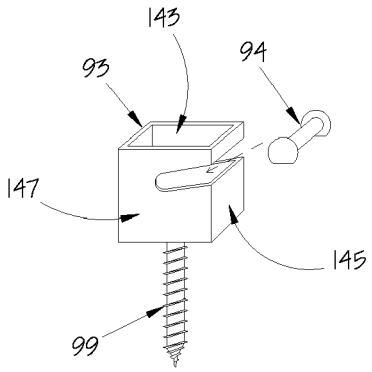
FIG. 25 illustrates a perspective left side enlarged view of the extension seen in FIG. 22.

Proximal end 104 of shaft 91 is positioned within extension 93 and rests on cylindrical locking pin 94 (FIG. 31) which acts as a stop for shaft 91 and resides in slot 95 also seen in FIGS. 23, 24. In the schematic exploded view of baluster 90 shown in FIG. 23, shaft 91 is seen prior to connection to handrail 60 and stair tread 102. Shoe 96 and cap 97 are slidably mounted on baluster shaft 91 for subsequent placement against respectively stair tread 102 and handrail 60 for aesthetic purposes.

The method of installing baluster 90 can be quickly accomplished by utilizing a conventional socket wrench 110 and adapter 111 as illustrated in FIG. 24. Adapter 111 includes shaft 112 which replicates the diameter of proximal end 104 of shaft 91 and thus fits within extension 93. Once adapter 111 is inserted into extension 93 adapter 111 can be lightly tapped with for example a hammer to allow anchor 99 to slightly penetrate the top surface of stair tread 102. With adapter 111 joined to extension 93, wrench 110 is then inserted into adapter 111 as standard and wrench 110, which preferably is of the reversible ratchet type, is then turned clockwise as seen by directional arrows 113 in FIG. 24 to completely thread anchor 99 into stair tread 102 as shown in FIG. 22 for stability purposes. Once anchor 99 is fully seated, adapter 111 and wrench 110 are removed, shoe 96 is then placed on shaft 91 and proximal end 104 is then fully inserted into extension 93 extending below angled slot 95. Cap 97 is then placed on distal end 105 of shaft 91. Shaft 91 is then raised to allow distal end 105 of shaft 91 to penetrate pre-drilled tubular channel 106 in handrail 60 as shown for example in FIGS. 22 and 23. With shaft 91 raised and distal end 105 seated in channel 106 locking pin 94 is then inserted in slot 95 of extension 93 and shaft 91 is then lowered to rest on pin 94. Angled slot 95 prevents locking pin 94 from easily escaping therefrom. Set screw 114 in extension 93 is then tightened against proximal end 104 of shaft 91. Next, extension 93 which is threaded into stair tread 102 can be rotated slightly (½-1½ turns) to accommodate the height required for shaft 91 if needed to direct baluster shaft 91 upwardly as a final adjustment to cause shaft 91 to be rigidly joined both to stair tread 102 and handrail 60.

As would be understood, by lifting shaft 91 upwardly for attachment with handrail 60, locking pin 94 can be placed within slot 95 of extension 93. For example, if shaft 91 needs to be longer to properly engage handrail 60, then anchor 99 of extension 93 is turned to move extension 93 upwardly toward handrail 60 as needed. If shaft 91 requires a shorter length then extension 93 is turned to move extension 93 downward toward stair tread 102 and positioned accordingly for rigid placement of baluster 90 between stair tread 102 and handrail 60.

Once baluster shaft 91 is firmly engaged between stair tread 102 and handrail 60, shoe 96 is lowered along shaft 91 to engage stair tread 102 and set screws 115 are tightened to maintain shoe 96 against extension 93 and stair tread 102. Cap is raised upwardly along shaft 91 to engage handrail 60 whereby set screws 98 are tightened to maintain cap 97 against shaft 91 and handrail 60. Shoe 96 conceals the lower attachment of extension 93 to stair tread 102 while cap 97 conceals the upper attachment of shaft 91 to handrail 60 for aesthetic purposes. After properly affixing shoe 96 and cap 97 the installation of baluster 90 is complete. FIGS. 22-24 show generally the steps for the method of installation of baluster 90 which as would be understood, the steps can be performed in reverse order for baluster removal or further length adjustment as required.

Figure 31:
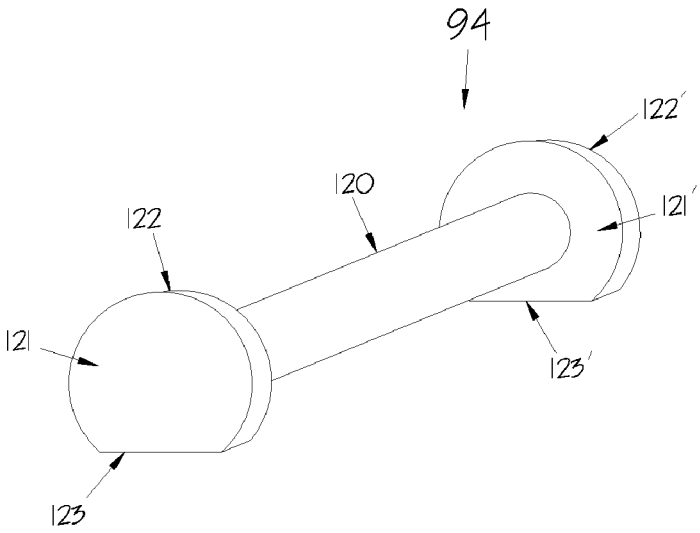
FIG. 31 depicts an enlarged perspective view of the locking pin seen in FIG. 22 as removed from the extension.
Figure 32:
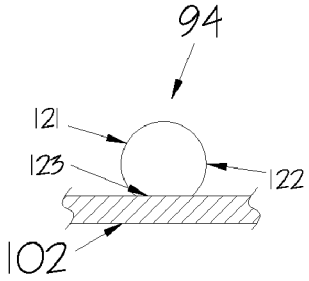
FIG. 32 features an end view of the locking pin shown in FIG. 31.
Figure 33:
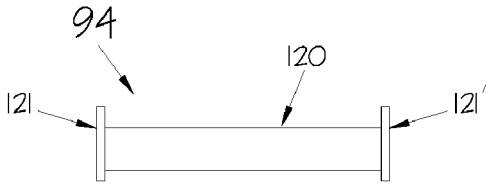
FIG. 33 pictures a top plan view of the locking pin shown in FIG. 31.
Figure 34:
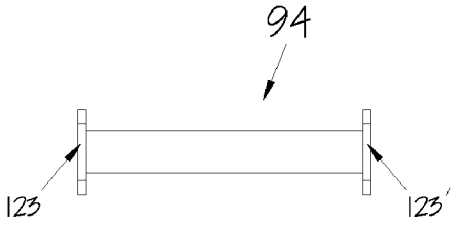
FIG. 34 shows a bottom plan view of the locking pin shown in FIG. 31.

In FIGS. 25-34 various views of extension 93 and locking pin 94 are shown. Locking pin 94 is seen in an enlarged perspective view in FIG. 31. As seen locking pin 94 includes axle 120 with hubs 121, 121' having partial circular peripheries 122, 122' and flattened sections 123, 123'. Locking pin 94 is preferably formed from steel but other suitable materials such as rigid plastics may be employed. In FIG. 32 an end view of locking pin 94 is seen to better illustrate circular periphery 122 and flattened section 123 of hub 121. Flattened sections 123, 123' prevent locking pin 94 from rolling and escaping a workmen as oftentimes small objects such as nails, screws, etc. are dropped by workmen requiring the dropped object to be retrieved, sometimes many feet below while on a stairway. By having flattened sections 123, 123' as shown in FIGS. 31, 32 and 34 on each hub 121, 121' locking pins 94 tend to remain nearby when dropped.

The illustrations and examples provided herein are for explanatory purposes and are not intended to limit the scope of the appended claims.

We claim:

1. A baluster comprising: a shaft, said shaft defining a proximal end, an extension, said proximal end slideably positioned within said extension, said extension comprising a hollow body, said body defining an acutely angled pin slot and an anchor, said anchor affixed to said body.

2. The baluster of claim 1 wherein said body comprises a front, a rear, a left side and a right side.

3. The baluster of claim 2 wherein said acutely angled pin slot slopes downwardly from said front about 10-12 degrees.

4. The baluster of claim 1 wherein said extension is rectangularly shaped.

5. The baluster of claim 1 further comprising a locking pin, said locking pin positioned in said acutely angled pin slot.

6. The baluster of claim 5 wherein said proximal end rests on said locking pin.

7. The baluster of claim 5 wherein said locking pin comprises an axle, a hub, said hub affixed to said axle, said hub defining a circular periphery with a linear section.

8. The baluster of claim 1 further comprising a shoe, said shoe slideably mounted on said shaft, said shoe for concealing said extension when mounted on a stair tread.

9. The baluster of claim 1 further comprising a cap, said cap slideably affixed to said shaft, said cap for stabilizing said baluster against a handrail.

10. A stairway baluster for attachment to a stair tread for supporting a handrail comprising: a shaft, said shaft defining a proximal end, an extension, said extension slideably mounted on said proximal end of said shaft, said extension comprising a hollow body, a threaded anchor, said threaded anchor joined to said body below said shaft, said anchor for retaining said extension on the stair tread, said body defining an acutely angled slot, a locking pin, said locking pin positioned in said acutely angled slot, and said proximal end above and resting on said locking pin.

11. The baluster of claim 10 further comprising a shoe, said shoe slidably positioned on said shaft, said shoe for concealing said extension.

12. The baluster of claim 10 further comprising a cap, said cap slidably mounted on said shaft, said cap for concealing the attachment of said shaft to the handrail.

13. A baluster comprising: a shaft, said shaft defining a proximal end, an extension, said proximal end slideably positioned within said extension, said extension comprising a hollow body, said hollow body comprising a front, a left side, a right side, said body defining an acutely angled pin slot in said left side and said right side, said pin slot extending downwardly from said front, an anchor, said anchor affixed to said body below said angled pin slot.

14. The baluster of claim 13 wherein said hollow body further defines a rear.

15. The baluster of claim 13 further comprising a locking pin, said locking pin positioned across said body in said left side and said right side pin slots.

16. The baluster of claim 15 wherein said proximal end rests on said locking pin.

17. The baluster of claim 13 further comprising a shoe, said shoe slideably positioned on said shaft for concealing said extension.

18. The baluster of claim 13 further comprising a cap, said cap slideably positioned on said shaft.

* * * * *